US007897035B2

(12) United States Patent
Chabot

(10) Patent No.: US 7,897,035 B2
(45) **Date of Patent: *Mar. 1, 2011**

(54) SYSTEMS AND METHODS FOR PRODUCING A CRUDE PRODUCT

(75) Inventor: Julie Chabot, Novato, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 422 days.

This patent is subject to a terminal disclaimer.

(21) Appl. No.: 12/212,796

(22) Filed: Sep. 18, 2008

(65) Prior Publication Data

US 2010/0065472 A1 Mar. 18, 2010

(51) Int. Cl.
*C10G 45/00* (2006.01)

(52) U.S. Cl. ..... 208/59; 208/57; 208/58

(58) Field of Classification Search ..... 208/57–59
See application file for complete search history.

(56) References Cited

U.S. PATENT DOCUMENTS 3,817,856 A 6/1974 Aaron et al.
4,485,004 A 11/1984 Fisher et al.
4,591,426 A 5/1986 Krasuk et al.
4,592,827 A 6/1986 Galiasso et al.
4,612,109 A 9/1986 Dillon et al.
4,684,456 A 8/1987 Van Driesen et al.
4,710,486 A 12/1987 Lopez et al.
4,824,821 A 4/1989 Lopez et al.
4,943,547 A 7/1990 Seamans et al.
4,970,190 A 11/1990 Lopez et al.
5,039,392 A 8/1991 Bearden et al.
5,041,404 A 8/1991 Seamans et al.
5,162,282 A 11/1992 Lopez et al.
5,164,075 A 11/1992 Lopez et al.
5,178,749 A 1/1993 Lopez et al.
5,298,152 A 3/1994 Kramer et al.
5,371,308 A 12/1994 Gosselink et al.
5,374,348 A 12/1994 Sears et al.
5,484,755 A 1/1996 Lopez et al.
5,527,473 A 6/1996 Ackerman
5,871,638 A 2/1999 Pradhan et al.
5,914,010 A 6/1999 Hood et al.
5,925,238 A 7/1999 Duddy et al.
5,935,418 A 8/1999 Chakrabarty et al.
5,954,945 A 9/1999 Cayton et al.
5,977,192 A 11/1999 Howsmon et al.
6,071,402 A 6/2000 Danot et al.
6,139,723 A 10/2000 Pelrine et al.
6,156,693 A 12/2000 Song et al.
6,156,695 A 12/2000 Soled et al.
6,162,350 A 12/2000 Soled et al.

(Continued)

OTHER PUBLICATIONS

Pending U.S. Appl. No. 12/506,840, filed Jul. 21, 2009.

(Continued)

*Primary Examiner* — Walter D Griffin
*Assistant Examiner* — Brian McCaig

(57) ABSTRACT

Systems and methods for hydroprocessing a heavy oil feedstock, the system employs a plurality of contacting zones and separation zones with at least some of the heavy oil feedstock being supplied to at least a contacting zone other than the first contacting zone. The contacting zones operate under hydrocracking conditions, employing a slurry catalyst for upgrading the heavy oil feedstock, forming upgraded products of lower boiling boiling hydrocarbons. In the separation zones, upgraded products are removed overhead and optionally, further treated in an in-line hydrotreater. At least a portion of the non-volatile fractions recovered from at least one of the separation zones is recycled back to the first contacting zone in the system.

26 Claims, 6 Drawing Sheets

U.S. PATENT DOCUMENTS 6,190,542 B1 2/2001 Comolli et al.
6,241,874 B1 6/2001 Wallace et al.
6,270,654 B1 8/2001 Colyar et al.
6,274,530 B1 8/2001 Cayton et al.
6,277,895 B1 8/2001 Zhou et al.
6,278,034 B1 8/2001 Espinoza et al.
6,291,391 B1 9/2001 MacArthur et al.
6,299,760 B1 10/2001 Soled et al.
6,451,729 B1 9/2002 Song et al.
6,534,437 B2 3/2003 Eijsbouts et al.
6,554,994 B1 4/2003 Reynolds et al.
6,620,313 B1 9/2003 Demmin et al.
6,630,066 B2 10/2003 Cash et al.
6,635,599 B1 10/2003 Eijsbouts et al.
6,652,738 B2 11/2003 Eijsbouts et al.
6,660,157 B2 12/2003 Que et al.
6,712,955 B1 3/2004 Hou et al.
6,726,832 B1 4/2004 Baldassari et al.
6,758,963 B1 7/2004 Hantzer et al.
7,150,823 B2 12/2006 Mayer et al.
7,179,366 B2 2/2007 Harle et al.
7,214,308 B2 5/2007 Colyar
7,223,713 B2 5/2007 Alonso et al.
7,232,515 B1 6/2007 Demmin et al.
7,297,250 B2 11/2007 Bronicki
7,358,413 B2 4/2008 Stell et al.
7,413,669 B2 8/2008 Gonzalez et al.
7,416,653 B2 8/2008 Wellington et al.
2002/0010088 A1 1/2002 Eijsbouts et al.
2002/0125172 A1 9/2002 Que et al.
2002/0166797 A1 11/2002 Banerjee
2003/0089636 A1 5/2003 Marchionna et al.
2003/0102254 A1 6/2003 Eijsbouts et al.
2003/0150778 A1 8/2003 Haluska et al.
2004/0134837 A1 7/2004 Dassori et al.
2004/0163999 A1 8/2004 Plantenga et al.
2004/0226860 A1 11/2004 Bourges et al.
2005/0040080 A1 2/2005 Riley et al.
2005/0145538 A1 7/2005 Wellington et al.
2005/0145543 A1 7/2005 Bhan et al.
2005/0150818 A1 7/2005 Bhan et al.
2005/0155908 A1 7/2005 Bhan et al.
2005/0167320 A1 8/2005 Bhan et al.
2005/0167321 A1 8/2005 Wellington et al.
2005/0167322 A1 8/2005 Wellington et al.
2005/0167323 A1 8/2005 Wellington et al.
2005/0167324 A1 8/2005 Bhan et al.
2005/0167326 A1 8/2005 Bhan et al.
2005/0167327 A1 8/2005 Bhan et al.
2005/0167328 A1 8/2005 Bhan et al.
2005/0167329 A1 8/2005 Bhan et al.
2005/0167330 A1 8/2005 Bhan et al.
2005/0167331 A1 8/2005 Bhan et al.
2005/0167332 A1 8/2005 Bhan et al.
2005/0173298 A1 8/2005 Wellington et al.
2005/0173301 A1 8/2005 Bhan et al.
2005/0173302 A1 8/2005 Bhan et al.
2005/0173303 A1 8/2005 Bhan et al.
2005/0241991 A1 11/2005 Lott et al.
2005/0241992 A1 11/2005 Lott et al.
2005/0241993 A1 11/2005 Lott et al.
2006/0011511 A1 1/2006 Hokari et al.
2006/0054535 A1 3/2006 Chen et al.
2006/0060501 A1 3/2006 Gauthier et al.
2006/0060502 A1 3/2006 Soled et al.
2006/0060503 A1 3/2006 Soled et al.
2006/0157385 A1 7/2006 Montanari et al.
2006/0163115 A1 7/2006 Montanari et al.
2006/0175229 A1 8/2006 Montanari et al.
2006/0186021 A1 8/2006 Marchionna et al.
2006/0201854 A1 9/2006 Lott et al.
2006/0207917 A1 9/2006 Domokos et al.
2006/0231465 A1 10/2006 Bhan et al.
2006/0272982 A1 12/2006 Montanari et al.
2006/0289340 A1 12/2006 Brownscombe et al.
2007/0000808 A1 1/2007 Bhan et al.
2007/0000810 A1 1/2007 Bhan et al.
2007/0012595 A1 1/2007 Brownscombe et al.
2007/0045156 A1 3/2007 Khadzhiev et al.
2007/0084754 A1 4/2007 Soled et al.
2007/0090023 A1 4/2007 Soled et al.
2007/0090024 A1 4/2007 Soled et al.
2007/0138059 A1* 6/2007 Farshid et al. ..... 208/57
2007/0158236 A1 7/2007 Zhou et al.
2007/0158238 A1 7/2007 Wu et al.
2007/0161505 A1 7/2007 Pereira-Almao et al.
2007/0238607 A1 10/2007 Alonso et al.
2007/0284285 A1 12/2007 Stepanik et al.
2007/0295641 A1 12/2007 Brownscombe et al.
2007/0295645 A1 12/2007 Brownscombe et al.
2007/0295646 A1 12/2007 Bhan et al.
2007/0295647 A1 12/2007 Brownscombe et al.
2008/0083650 A1 4/2008 Bhan et al.
2008/0083652 A1 4/2008 Morel et al.
2008/0083655 A1 4/2008 Bhan et al.
2008/0085225 A1 4/2008 Bhan et al.
2008/0087575 A1 4/2008 Bhan et al.
2008/0087578 A1 4/2008 Bhan et al.
2008/0099371 A1 5/2008 McCoy et al.

OTHER PUBLICATIONS

Pending U.S. Appl. No. 12/506,885, filed Jul. 21, 2009.
Pending U.S. Appl. No. 12/506,987, filed Jul. 21, 2009.
Pending U.S. Appl. No. 12/506,937, filed Jul. 21, 2009.
Pending U.S. Appl. No. 12/212,737, filed Sep. 18, 2008.
Pending U.S. Appl. No. 12/233,171, filed Jul. 21, 2009.
Pending U.S. Appl. No. 12/233,393, filed Jul. 21, 2009.
Pending U.S. Appl. No. 12/233,439, filed Jul. 21, 2009.
Pending U.S. Appl. No. 12/212,796, filed Sep. 18, 2008.
Pending U.S. Appl. No. 12/233,327, filed Sep. 18, 2008.
Hydrodesulfurization Catalysis by Transition Metal Sulfides by Pecoraro et al., Journal of Catalysis 67, 430-445 (1981).
A review of zinc dialkyldithiophosphates (ZDDPS): characterization and role in the lubricating oil by Barnes et al., Tribology International 34 (2001) 389-395.
Petroleum residue upgrading with dispersed catalysts Part I. Catalysts activity and selectivity. Applied Catalysis A: General 204 (2000) 203-213.
Iron sulfide Catalysts for Coal Liquefaction Prepared Using a Micellar Technique by Chadha et al., Ind. Eng. Chem. Res. 1996, 35, 2916-2919.
Nickel, Cadium and Lead Sulfides as Catalysts in the Vapor Phase Reduction of Nitrobenzene by Brown et al., Laboratory of Physical Chemistry, Indiana University, Jul. 29, 1938.
Solution Synthesis of the unsupported Ni-W sulfide hytrotreating catalysts by Le et al., Catalysis Today 130 (2008) 24-31.
Thermal decomposition of sulfur comppunds. I. 2-Methyl-2-propanethiol by Thompson et al., Bureau of Mines, Petroleum and Oil-Shale Experiment Station, Nov. 19, 1951.
Hydroprocessing of heavy petroleum feeds: tutorial by Ancheyta et al. Catalysis today 109 (2005) 3-15.
A review of recent advances on process technologies for upgrading of heavy oils and residue by Rana et al., Fuel 86 (2007) 1216-1231.

* cited by examiner

SYSTEMS AND METHODS FOR PRODUCING A CRUDE PRODUCT

CROSS-REFERENCE TO RELATED APPLICATIONS

NONE.

TECHNICAL FIELD

The invention relates to systems and methods for treating or upgrading heavy oil feeds, and crude products produced using such systems and methods.

BACKGROUND

The petroleum industry is increasingly turning to heavy oil feeds such as heavy crudes, resids, coals, tar sands, etc. as sources for feedstocks. These feedstocks are characterized by high concentrations of asphaltene rich residues, and low API gravities, with some being as low as less than 0° API.

US Patent Publication No. 2008/0083650. US Patent Publication No. 2007/0138057. and U.S. Pat. No. 6,660,157 describe processes, systems, and catalysts for processing heavy oil feeds. In the prior art, a hydroprocessing unit typically comprises multiple reactors (or contacting zones) in series. A fresh catalyst (or regenerated catalyst) is fed into the first reactor with the heavy oil feedstock (untreated or treated, e.g., solvent deasphalted, thermally treated, etc.). Also in the prior art, the heavy oil feed enters the first (upstream) contacting zone. The unconverted oil, catalyst from the first reactor, and some make-up catalyst continues on to the next reactor in series until all the unconverted oil is converted to lower boiling point crude oils.

There is still a need for improved systems and methods to upgrade/treat process heavy oil feeds using novel feed schemes.

SUMMARY OF THE INVENTION

In one aspect, this invention relates to a process for by which a heavy oil feedstock can be upgraded. The process employs a plurality of contacting zones and separation zones, the process comprising: a) a heavy oil feedstock with at least a portion of the heavy oil feedstock is fed to a contacting zone other than the first contacting zone; b) combining a hydrogen containing gas feed, a portion of the heavy oil feedstock, and a slurry catalyst in a first contacting zone under hydrocracking conditions to convert at least a portion of the heavy oil feedstock to upgraded products; c) sending a mixture of the upgraded products, the slurry catalyst, the hydrogen containing gas, and unconverted heavy oil feedstock to a separation zone; d) in the separation zone, removing the upgraded products with the hydrogen containing gas as an overhead stream, and removing the slurry catalyst and the unconverted heavy oil feedstock as a non-volatile stream; e) sending the non-volatile stream to another contacting zone under hydrocracking conditions with additional hydrogen gas, at least a portion of the heavy oil feedstock, and optionally, fresh slurry catalyst to convert the unconverted heavy oil feedstock to upgraded products; f) sending the upgraded products, the slurry catalyst, hydrogen, and unconverted heavy oil feedstock to a separation zone, whereby the upgraded products are removed with hydrogen as an overhead stream and the slurry catalyst and the unconverted heavy oil feedstock are removed as a non-volatile stream; and g) recycling to the first contacting zone at least a portion of the non-volatile stream.

In another aspect, there is provided a process employing a plurality of contacting zones and separation zones in which a heavy oil feedstock can be upgraded, and wherein the fresh slurry catalyst is split between the contacting zones.

In yet another aspect, the invention relates to a method for upgrading a heavy oil feedstock employing a plurality of contacting zones and separation zones, and at least 10% of the total heavy oil feedstock is fed to the last contacting zone.

DETAILED DESCRIPTION

Figure 1:
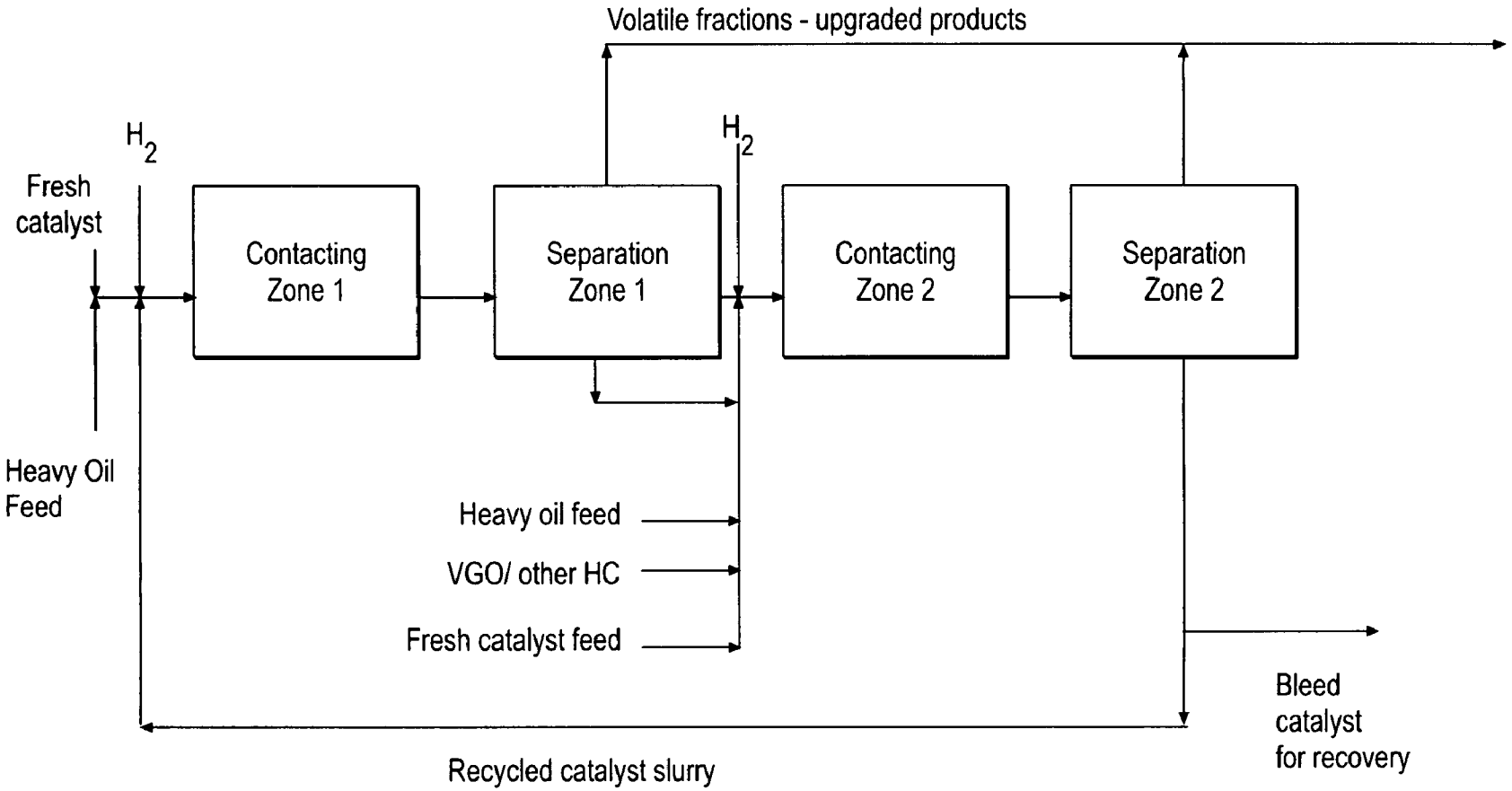
FIG. 1 is a block diagram that schematically illustrates an embodiment of a hydroprocessing system for upgrading a heavy oil feedstock, having a split fresh catalyst feed scheme, a split heavy oil feed scheme, and additional interstage hydrocarbon oil feedstock.

In a typical prior art hydroprocessing system having a plurality of contacting zones (reactors) in series, it is observed that the feed stream to the $2^{nd}$ contacting zone should generally be cleaner than heavy oil feed into the first contacting zone in the system, i.e., having less impurities such as nickel, vanadium, nitrogen, sulfur, etc., as the heavy oil has gone through a treatment process in the first contacting zone. It is also observed that the feed stream into the last contacting zone in the system should generally be cleaner than the feed stream to the prior contacting zone(s) in the system.

In a typical hydroprocessing system, it has been further observed that in the catalyst feed scheme of the prior art, the feed streams to the subsequent contacting zones in the system are typically more concentrated in terms of certain impurities, e.g., MCR, $C_5$ and $C_7$ asphaltenes contents, etc., thus promoting coke formation in the latter contacting zones in the system.

It has also been observed that the feed stream to subsequent contacting zones in the system has properties different than the properties of the heavy oil feed to the preceding contacting zone(s) in the system, including: a) lower TAN; b) viscosity; c) lower residue content; d) lower API gravity; e) lower content of metals in metal salts of organic acids; and g) combinations thereof However, it has also been observed that it is generally more difficult to process the feed to the subsequent contacting zones in the system in terms of the conversion rate and/or the properties of the resulting crude product. Additionally with the prior art feeding scheme (fresh catalyst going to the $1^{st}$ contacting zone), it is observed that there is more coke formation in the subsequent contacting zones than in the 1st contacting zone. It is speculated that the coke formation perhaps has something to do with the more-difficult-to-process feed to the subsequent contacting zones and/or the reduced activity of the catalyst feed to the subsequent contacting zones.

In some embodiments of the present invention, instead of sending all of the fresh catalyst to the first contacting zone as in the prior art process, at least a portion of the fresh catalyst is diverted to at least one other contacting zones (other than the 1st contacting zone) in the system.

Also in some embodiments of the present invention, instead of sending all of the heavy oil feed to be upgraded to the first contacting zone, at least a portion of the heavy oil feed is diverted to at least one other contacting zones in the system.

In other embodiments, a combination feed scheme is employed with a portion of the fresh catalyst feed and a portion of the heavy oil feed being diverted to at least one other contact zones other than the first contacting zone in the heavy oil upgrading system.

The following terms will be used throughout the specification and will have the following meanings unless otherwise indicated.

As used herein, "heavy oil" feed or feedstock refers to heavy and ultra-heavy crudes, including but not limited to resids, coals, bitumen, tar sands, etc. Heavy oil feedstock may be liquid, semi-solid, and/or solid. Examples of heavy oil feedstock that might be upgraded as described herein include but are not limited to Canada Tar sands, vacuum resid from Brazilian Santos and Campos basins, Egyptian Gulf of Suez, Chad, Venezuelan Zulia, Malaysia, and Indonesia Sumatra. Other examples of heavy oil feedstock include residuum left over from refinery processes, including "bottom of the barrel" and "residuum" (or "resid")—atmospheric tower bottoms, which have a boiling point of at least 343° C. (650° F.), or vacuum tower bottoms, which have a boiling point of at least 524° C. (975° F.), or "resid pitch"and "vacuum residue"—which have a boiling point of 524° C. (975° F.) or greater.

Properties of heavy oil feedstock may include, but are not limited to: TAN of at least 0.1. at least 0.3. or at least 1; viscosity of at least 10 cSt; API gravity at most 15 in one embodiment, and at most 10 in another embodiment. A gram of heavy oil feedstock typically contains at least 0.0001 grams of Ni/V/Fe; at least 0.005 grams of heteroatoms; at least 0.01 grams of residue; at least 0.04 grams C5 asphaltenes; at least 0.002 grams of MCR; per gram of crude; at least 0.00001 grams of alkali metal salts of one or more organic acids; and at least 0.005 grams of sulfur. In one embodiment, the heavy oil feedstock has a sulfur content of at least 5 wt. % and an API gravity ranging from −5 to +5. A heavy oil feed comprises Athabasca bitumen (Canada) typically has at least 50% by volume vacuum reside. A Boscan (Venezuala) heavy oil feed may contain at least 64% by volume vacuum residue.

The terms "treatment," "treated," "upgrade", "upgrading" and "upgraded", when used in conjunction with a heavy oil feedstock, describes a heavy oil feedstock that is being or has been subjected to hydroprocessing, or a resulting material or crude product, having a reduction in the molecular weight of the heavy oil feedstock, a reduction in the boiling point range of the heavy oil feedstock, a reduction in the concentration of asphaltenes, a reduction in the concentration of hydrocarbon free radicals, and/or a reduction in the quantity of impurities, such as sulfur, nitrogen, oxygen, halides, and metals.

The upgrade or treatment of heavy oil feeds is generally referred herein as "hydroprocessing." Hydroprocessing is meant as any process that is carried out in the presence of hydrogen, including, but not limited to, hydroconversion, hydrocracking, hydrogenation, hydrotreating, hydrodesulfurization, hydrodenitrogenation, hydrodemetallation, hydrodearomatization, hydroisomerization, hydrodewaxing and hydrocracking including selective hydrocracking. The products of hydroprocessing may show improved viscosities, viscosity indices, saturates content, low temperature properties, volatilities and depolarization, etc.

As used herein, hydrogen refers to hydrogen, and/or a compound or compounds that when in the presence of a heavy oil feed and a catalyst react to provide hydrogen.

SCF/BBL (or scf/bbl) refers to a unit of standard cubic foot of gas ($N_2$, $H_2$, etc.) per barrel of hydrocarbon feed.

$Nm^3/m^3$ refers to normal cubic meters of gas per cubic meter of heavy oil feed.

VGO or vacuum gas oil, referring to hydrocarbons with a boiling range distribution between 343° C. (650° F.) and 538° C. (1000° F.) at 0.101 MPa.

As used herein, the term "catalyst precursor" refers to a compound containing one or more catalytically active metals, from which compound a catalyst is eventually formed. It should be noted that a catalyst precursor may be catalytically active as a hydroprocessing catalyst. As used herein, "catalyst precursor" may be referred herein as "catalyst" when used in the context of a catalyst feed.

As used herein, the term "used catalyst" refers to a catalyst that has been used in at least a reactor in a hydroprocessing operation and whose activity has thereby been diminished. For example, if a reaction rate constant of a fresh catalyst at a specific temperature is assumed to be 100%, the reaction rate constant for a used catalyst is 95% or less in one embodiment, 80% or less in another embodiment, and 70% or less in a third embodiment. The term "used catalyst" may be used interchangeably with "recycled catalyst," "used slurry catalyst" or "recycled slurry catalyst."

As used herein, the term "bleed stream" or "bleed off stream" refers to a stream containing recycled catalyst, being "bled" or diverted from the hydroprocessing system, helping to prevent or "flush" accumulated metallic sulfides and other unwanted impurities from the upgrading system.

In one embodiment, the bleed off stream comprises non-volatile materials from a separation zone in the system, typically the last separation zone, comprising unconverted materials, slurry catalyst, a small amount of heavier hydrocracked liquid products, small amounts of coke, asphaltenes, etc. In another embodiment, the bleed off stream is the bottom stream from an interstage solvent deasphalting unit in the system. In embodiments wherein the bleed off stream is diverted from the bottom stream of a separation zone, the bleed stream typically ranges from 1 to 35 wt. %; 3-20 wt. %; or 5-15wt. % of the total heavy oil feedstock to the system. In embodiments therein the bleed off stream is diverted from the bottom of a deasphalting unit, the bleed off stream ranges from 0.30 to 5 wt. %; 1-30 wt. %; or 0.5 to 10 wt. % of the heavy oil feed stock.

In one embodiment, the bleed-off stream contains between 3 to 30 wt. % slurry catalyst. In another embodiment, the slurry catalyst amount ranges from 5 to 20 wt. %. In yet another embodiment, the bleed-off stream contains an amount of slurry catalyst ranging from 1 to 15 wt. % in concentration.

As used herein, the term "fresh catalyst" refers to a catalyst or a catalyst precursor that has not been used in a reactor in a hydroprocessing operation. The term fresh catalyst herein also includes "re-generated" or "rehabilitated" catalysts, i.e., catalyst that has been used in at least a reactor in a hydroprocessing operation ("used catalyst") but its catalytic activity has been restored or at least increased to a level well above the used catalytic activity level. The term "fresh catalyst" may be used interchangeably with "fresh slurry catalyst."

As used herein, the term "slurry catalyst" (or sometimes referred to as "slurry", or "dispersed catalyst") refers to a liquid medium, e.g., oil, water, or mixtures thereof, in which catalyst and/or catalyst precursor particles (particulates or crystallites) having very small average dimensions are dispersed within. In one embodiment, the medium (or diluent) is a hydrocarbon oil diluent. In another embodiment, the liquid medium is the heavy oil feedstock itself. In yet another embodiment, the liquid medium is a hydrocarbon oil other than the heavy oil feedstock, e.g., a VGO medium or diluent.

In one embodiment, the slurry catalyst stream contains a fresh catalyst. In another embodiment, the slurry catalyst stream contains a mixture of at least a fresh catalyst and a recycled catalyst. In a third embodiment, the slurry catalyst stream comprises a recycled catalyst. In another embodiment, the slurry catalyst contains a well-dispersed catalyst precursor composition capable of forming an active catalyst in situ within the feed heaters and/or the contacting zone. The catalyst particles can be introduced into the medium (diluent) as powder in one embodiment, a precursor in another embodiment, or after a pre-treatment step in a third embodiment.

As used herein, the "catalyst feed" includes any catalyst suitable for upgrading heavy oil feed stocks, e.g., one or more bulk catalysts and/or one or more catalysts on a support. The catalyst feed may include at least a fresh catalyst, recycled catalyst only, or mixtures of at least a fresh catalyst and recycled catalyst. In one embodiment, the catalyst feed is in the form of a slurry catalyst.

As used herein, the term "bulk catalyst" may be used interchangeably with "unsupported catalyst," meaning that the catalyst composition is NOT of the conventional catalyst form, i.e., having a preformed, shaped catalyst support loaded with metals via impregnation or deposition catalyst. In one embodiment, the bulk catalyst is formed through precipitation. In another embodiment, the bulk catalyst has a binder incorporated into the catalyst composition. In yet another embodiment, the bulk catalyst is formed from metal compounds and without any binder. In a fourth embodiment, the bulk catalyst is a dispersing-type catalyst for use as dispersed catalyst particles in mixture of liquid (e.g., hydrocarbon oil). In one embodiment, the catalyst comprises one or more commercially known catalysts, e.g., Microcat™ from ExxonMobil Corp.

As used herein, the term "contacting zone" refers to an equipment in which the heavy oil feed is treated or upgraded by contact with a slurry catalyst feed in the presence of hydrogen. In a contacting zone, at least a property of the crude feed may be changed or upgraded. The contacting zone can be a reactor, a portion of a reactor, multiple portions of a reactor, or combinations thereof. The term "contacting zone" may be used interchangeably with "reacting zone."

In one embodiment, the upgrade process comprises a plurality of reactors for contacting zones, with the reactors being the same or different in configurations. Examples of reactors that can be used herein include stacked bed reactors, fixed bed reactors, ebullating bed reactors, continuous stirred tank reactors, fluidized bed reactors, spray reactors, liquid/liquid contactors, slurry reactors, liquid recirculation reactors, and combinations thereof. In one embodiment, the reactor is an up-flow reactor. In another embodiment, a down-flow reactor. In one embodiment, the contacting zone refers to at least a slurry-bed hydrocracking reactor in series with at least a fixed bed hydrotreating reactor. In another embodiment, at least one of the contacting zones further comprises an in-line hydrotreater, capable of removing over 70% of the sulfur, over 90% of nitrogen, and over 90% of the heteroatoms in the crude product being processed.

In one embodiment, the contacting zone comprises a plurality of reactors in series, providing a total residence time ranging from 0.1 to 15 hours. In a second embodiment, the resident time ranges from 0.5 to 5 hrs. In a third embodiment, the total residence time in the contacting zone ranges from 0.2 to 2 hours.

As used herein, the term "separation zone" refers to an equipment in which upgraded heavy oil feed from a contacting zone is either fed directly into, or subjected to one or more intermediate processes and then fed directly into the separation zone, e.g., a flash drum or a high pressure separator, wherein gases and volatile liquids are separated from the non-volatile fraction, which comprises unconverted heavy oil feed, a small amount of heavier hydrocracked liquid products (synthetic or non-volatile upgraded products), the slurry catalyst and any entrained solids (asphaltenes, coke, etc.). Depending on the conditions of the separation zone, in one embodiment, the amount of heavier hydrocracked products in the non-volatile fraction stream is less than 50 wt. % (of the total weight of the non-volatile stream). In a second embodiment, the amount of heavier hydrocracked products in the non-volatile stream from the separation zone is less than 25 wt. %. In a third embodiment, the amount of heavier hydrocracked products in the non-volatile stream from the separation zone is less than 15 wt. %. It should be noted that at least a portion of the slurry catalyst remains with the upgraded feedstock as the upgraded materials is withdrawn from the contacting zone and fed into the separation zone, and the slurry catalyst continues to be available in the separation zone and exits the separation zone with the non-volatile liquid fraction.

In one embodiment, both the contacting zone and the separation zone are combined into one equipment, e.g., a reactor having an internal separator, or a multi-stage reactor-separator. In this type of reactor-separator configuration, the vapor product exits the top of the equipment, and the non-volatile fraction exits the side or bottom of the equipment with the slurry catalyst and entrained solid fraction, if any.

In one embodiment, the upgrade system comprises two upflow reactors in series with two separators, with each separator being positioned right after each reactor. In another embodiment, the upgrade system comprises three upflow reactors and three separators in series, with each of the separators being positioned right after each reactor. In yet another embodiment, the upgrade system comprises a plurality of multi-stage reactor-separators in series. In a fourth embodiment, the upgrade system may comprise a combination of separate reactors and separate separators in series with multi-stage reactor-separators.

Embodiments of The Heavy Oil Split Feed Scheme: In some embodiments of the present invention, at least a portion of the heavy oil feed (to be upgraded) is "split" or diverted to at least one other contacting zones in the system (other than the first contacting zone).

In one embodiment, "at least a portion" meaning at least 5% of the heavy oil feed to be upgraded. In another embodiment, at least 10%. In a third embodiment, at least 20%. In a fourth embodiment, at least 30% of the heavy oil feed is diverted to at least a contacting zone other than the first one in the system.

In one embodiment, less than 90% of the unconverted heavy oil feed is fed to the first reactor in the system, with 10% or more of the unconverted heavy oil feed being diverted to the other contacting zone(s) in the system. In another embodiment, the heavy oil feed is being equally split between the contacting zones in the system. In yet another embodiment, less than 80% of the unconverted heavy oil feed is fed to the first contacting zone in the system, and the remaining heavy oil feed is diverted to the last contacting zone in the system. In a fourth embodiment, less than 60% of the heavy oil feed is fed to the first contacting zone in the system, and the remainder of the unconverted heavy oil feed is equally split between the other contacting zones in the system.

The unconverted heavy oil feed herein may comprise one or more different heavy oil feeds from different sources as a single feed stream or separate heavy oil feed streams. In one embodiment, a single heavy oil conduit pipe goes to all the contacting zones. In another embodiment, multiple heavy oil conduits are employed to supply the heavy oil feed to the different contacting zones, with some heavy oil feed stream(s) going to one or more contacting zones, and some of the other unconverted heavy oil feed stream(s) going to one or more different contacting zones.

In one embodiment, the heavy oil feedstock is preheated prior to being blended with the slurry catalyst feed, and/or prior to being introduced into the hydrocracking reactors (contacting zones). In another embodiment, the blend of heavy oil feedstock and slurry catalyst feed is preheated to create a feedstock that is sufficiently of low viscosity to allow good mixing of the catalyst into the feedstock.

In one embodiment, the preheating is conducted at a temperature that is about 100° C. (180° F.) less than the hydrocracking temperature within the contacting zone. In another embodiment, the preheating is at a temperature that is about 50° C. less than the hydrocracking temperature within the contacting zone.

Optional Treatment System—SDA: In one embodiment of the invention, a solvent deasphalting unit (SDA) is employed before the first contacting zone to pre-treat the heavy oil feedstock. In yet another embodiment, a solvent deasphalting unit is employed as an intermediate unit located after one of the intermediate separation zones.

SDA units are typically used in refineries to extract incremental lighter hydrocarbons from a heavy hydrocarbon stream, whereby the extracted oil is typically called deasphalted oil (DAO), while leaving a residue stream behind that is more concentrated in heavy molecules and heteroatoms, typically known as SDA Tar, SDA Bottoms, etc. The SDA can be a separate unit or a unit integrated into the upgrade system.

Various solvents may be used in the SDA, ranging from propanes to hexanes, depending on the desired level of deasphalting prior to feeding the contact zone. In one embodiment, the SDA is configured to produce a deasphalted oil (DAO) for blending with the catalyst feed or feeding directly into the contacting zones instead of, or in addition to the heavy oil feed. As such, the solvent type and operating conditions can be optimized such that a high volume and acceptable quality DAO is produced and fed to the contacting zone. In this embodiment, a suitable solvent to be used includes, but is not limited to hexane or similar C6+ solvent for a low volume SDA Tar and high volume DAO. This scheme would allow for the vast majority of the heavy oil feed to be upgraded in the subsequent contacting zone, while the very heaviest bottom of the barrel bottoms that does not yield favorable incremental conversion economics due to the massive hydrogen addition requirement, to be used in some other manner.

In one embodiment, all of the heavy oil feed is pre-treated in the SDA and the DAO product is fed into the first contacting zone, or fed according to a split feed scheme with at least a portion going to a contacting zone other than the first in the series. In another embodiment, some of the heavy oil feed (depending on the source) is first pre-treated in the SDA and some of the feedstock is fed directly into the contacting zone(s) untreated. In yet another embodiment, the DAO is combined with the untreated heavy oil feedstock as one feed stream to the contacting zone(s). In another embodiment, the DAO and the untreated heavy oil feedstock are fed to the system in separate feed conduits, with the DAO going to one or more of the contacting zones and the untreated heavy oil feed going to one or more of the same or different contacting zones.

In an embodiment wherein the SDA is employed as an intermediate unit, the non-volatile fraction containing the slurry catalyst and optionally minimum quantities of coke/asphaltenes, etc. from at least one of the separation zones is sent to the SDA for treatment. From the SDA unit, the DAO is sent to at least one of the contacting zones as a feed stream by itself, in combination with a heavy oil feedstock as a feed, or in combination with the bottom stream from one of the separation zones as a feed. The DA Bottoms containing asphaltenes are sent away to recover metal in any carry-over slurry catalyst, or for applications requiring asphaltenes, e.g., blended to fuel oil, used in asphalt, or utilized in some other applications.

In one embodiment, the quality of the DAO and SDA Bottoms is varied by adjusting the solvent used and the desired recovery of DAO relative to the heavy oil feed. In an optional pretreatment unit such as the SDA, the more DAO oil that is recovered, the poorer the overall quality of the DAO, and the poorer the overall quality of the SDA Bottoms. With respect to the solvent selection, typically, as a lighter solvent is used for the SDA, less DAO will be produced, but the quality will be better, whereas if a heavier solvent is used, more DAO will be produced, but the quality will be lower. This is due to, among other factors, the solubility of the asphaltenes and other heavy molecules in the solvent.

Embodiments of The Catalyst Split-Feed Scheme: In some embodiments of the present invention, at least a portion of the fresh catalyst is "split" or diverted to at least one other contacting zones in the system (other than the first contacting zone).

In one embodiment, "at least a portion" means at least 10% of the fresh catalyst. In another embodiment, at least 20%. In a third embodiment, at least 40%. In a fourth embodiment, at least 50% of the fresh catalyst is diverted to at least a contacting zone other than the first one in the system. In a fifth embodiment, all of the fresh catalyst is diverted to a contacting zone other than the $1^{st}$ contacting zone.

In one embodiment, less than 20% of the fresh catalyst is fed to the first reactor in the system, with 80% or more of the fresh catalyst being diverted to the other contacting zone(s) in the system. In another embodiment, the fresh catalyst is being equally split between the contacting zones in the system. In one embodiment, at least a portion of the fresh catalyst feed is sent to at least one of the intermediate contacting zones and/or the last contacting zone in the system. In another embodiment, all of the fresh catalyst is sent to the last contacting zone in the system, with the first contacting zone in the system only getting recycled catalyst from one or more of the processes in the system, e.g., from one of the separation zones in the system or from a solvent deasphalting unit.

In yet another embodiment (not illustrated), the process is configured for a flexible catalyst feed scheme such that the fresh catalyst can sometimes be fed entirely to the last reactor in the system for certain process conditions (for certain desired product characteristics), or 50% to the first reactor in the system for some of the process runs, or split equally or according to pre-determined proportions to all of the reactors in the system, or split according to pre-determined proportions for the same fresh catalyst to be fed to the different reactors at different concentrations.

The fresh catalyst feed used herein may comprise one or more different fresh catalysts as a single catalyst feed stream or separate feed streams. In one embodiment, a single fresh catalyst feed stream is supplied to the contacting zones. In another embodiment, the fresh catalyst feed comprises multiple and different fresh catalysts to the contacting zones, with some of fresh catalyst stream(s) going to one or more contacting zones, and some of the other fresh catalyst stream(s) going to one or more different contacting zones.

In one embodiment, the fresh catalyst is combined with the recycled catalyst stream from one of the processes in the system, e.g., a separation zone, a distillation column, a SDA unit, or a flash tank, and the combined catalyst feed is thereafter blended with heavy oil feedstock for feeding into the contacting zone(s). In another embodiment, the fresh catalyst and the recycled catalyst streams are blended into the heavy oil feedstock as separate streams.

In one embodiment, the fresh catalyst is first preconditioned before entering one of the contacting zones, or before being brought into in contact with the heavy oil feed before entering the contacting zones. In one example, the fresh catalyst enters into a preconditioning unit along with hydrogen at a rate from 500 to 7500 SCF/BBL (BBL here refers to the total volume of heavy oil feed to the system), wherein the mixture is heated to a temperature between 400° F. to 1000° F., and under a pressure of 300 to 2500 psi in one embodiment; 500-3000 psi in a second embodiment; and 600-3200 psi in a third embodiment. In another example, the catalyst is preconditioned in hydrogen at a temperature of 500 to 725° F. It is believed that instead of bringing a cold catalyst in contact with the heavy oil feed, the preconditioning step helps with the hydrogen adsorption into the active catalyst sites, and ultimately the conversion rate.

Catalysts Employed In the Split-Feed Scheme: In one embodiment, the catalyst is a multi-metallic catalyst comprising at least a Group VIB metal and optionally, at least a Group VIII metal (as a promoter), wherein the metals may be in elemental form or in the form of a compound of the metal.

In one embodiment, the catalyst is of the formula $(M^t)_a(X^u)_b(S^v)_d(C^w)_e(H^x)_f(O^y)_g(N^z)_h$, wherein M represents at least one group VIB metal, such as Mo, W, etc. or a combination thereof; and X functions as a promoter metal, representing at least one of: a non-noble Group VIII metal such as Ni, Co; a Group VIIIB metal such as Fe; a Group VIB metal such as Cr; a Group IVB metal such as Ti; a Group IIB metal such as Zn, and combinations thereof (X is hereinafter referred to as "Promoter Metal"). Also in the equation, t, u, v, w, x, y, z representing the total charge for each of the component (M, X, S, C, H, O and N, respectively); ta+ub+vd+we+xf+yg+zh=0. The subscripts ratio of b to a has a value of 0 to 5 (0<=b/a<=5). S represents sulfur with the value of the subscript d ranging from (a+0.5b) to (5a+2b). C represents carbon with subscript e having a value of 0 to 11(a+b). H is hydrogen with the value of f ranging from 0 to 7(a+b). O represents oxygen with the value of g ranging from 0 to 5(a+b); and N represents nitrogen with h having a value of 0 to 0.5(a+b). In one embodiment, subscript b has a value of 0. for a single metallic component catalyst, e.g., Mo only catalyst (no promoter).

In one embodiment, the catalyst is prepared from a mono-, di, or polynuclear molybdenum oxysulfide dithiocarbamate complex. In a second embodiment, the catalyst is prepared from a molybdenum oxysulfide dithiocarbamate complex.

In one embodiment, the catalyst is a $MoS_2$ catalyst, promoted with at least a group VIII metal compound. In another embodiment, the catalyst is a bulk multimetallic catalyst, wherein said bulk multimetallic catalyst comprises of at least one Group VIII non-noble metal and at least two Group VIB metals and wherein the ratio of said at least two Group VIB metals to said at least one Group VIII non-noble metal is from about 10:1 to about 1:10.

In one embodiment, the catalyst is prepared from catalyst precursor compositions including organometallic complexes or compounds, e.g., oil soluble compounds or complexes of transition metals and organic acids. Examples of such compounds include naphthenates, pentanedionates, octoates, and acetates of Group VIB and Group VII metals such as Mo, Co, W, etc. such as molybdenum naphthanate, vanadium naphthanate, vanadium octoate, molybdenum hexacarbonyl, and vanadium hexacarbonyl.

In one embodiment, the catalyst feed comprises slurry catalyst having an average particle size of at least 1 micron in a hydrocarbon oil diluent. In another embodiment, the catalyst feed comprises slurry catalyst having an average particle size in the range of 1-20 microns. In yet another embodiment, the catalyst comprises catalyst molecules and/or extremely small particles that are colloidal in size (i.e., less than 100 nm, less than about 10 nm, less than about 5 nm, and less than about 1 nm), which in a hydrocarbon diluent, forming a slurry catalyst having "clusters" of the colloidal particles, with the clusters having an average particle size in the range of 1-20 microns. In a fourth embodiment, the catalyst feed comprises a slurry catalyst having an average particle size in the range of 2-10 microns. In another embodiment, the feed comprises a slurry catalyst having an average particle size ranging from colloidal (nanometer size) to about 1-2 microns. In one embodiment, the catalyst comprises single layer $MoS_2$ clusters of nanometer sizes, e.g., 5-10 nm on edge.

In one embodiment, a sufficient amount of fresh catalyst and used catalyst is fed to the contacting zone(s) for each contacting zone to have a slurry (solid) catalyst concentration ranging from 2 to 30 wt. %. In a second embodiment, the catalyst concentration in the reactor ranges from 3 to 20 wt. %. In a third embodiment, from 5 to 10 wt. %.

In one embodiment, the amount of fresh catalyst feed into the contacting zone(s) range from 50 to 15000 wppm of Mo (concentration in heavy oil feed). In a second embodiment, the concentration of the fresh catalyst feed ranges from 150 to 2000 wppm Mo. In a third embodiment, from 250 to 5000 wppm Mo. In a fourth embodiment, the concentration is less than 10,000 wppm Mo. The concentration of the fresh catalyst into each contacting zone may vary depending on the contacting zone employed in the system, as catalyst may become more concentrated as volatile fractions are removed from a non-volatile resid fraction, thus requiring adjustment of the catalyst concentration.

Hydrogen Feed: In one embodiment, the hydrogen source is provided to the process at a rate (based on ratio of the gaseous hydrogen source to the crude feed) of 0.1 $Nm^3/m^3$ to about 100,000 $Nm^3/m^3$ (0.563 to 563,380 SCF/bbl), about 0.5 $Nm^3/m^3$ to about 10,000 $Nm^3/m^3$ (2.82 to 56,338 SCF/bbl), about 1 $Nm^3/m^3$ to about 8,000 $Nm^3/m^3$ (5.63 to 45,070 SCF/bbl), about 2 $Nm^3/m^3$ to about 5,000 $Nm^3/m^3$ (11.27 to 28,169 SCF/bbl), about 5 $Nm^3/m^3$ to about 3,000 $Nm^3/m^3$ (28.2 to 16,901 SCF/bbl), or about 10 $Nm^3/m^3$ to about 800 $Nm^3/m^3$ (56.3 to 4,507 SCF/bbl). In one embodiment, some of the hydrogen (25-75%) is supplied to the first contacting zone, and the rest is added as supplemental hydrogen to other contacting zones in system.

In one embodiment, the upgrade system produces a volume yield of at least 110% (compared to the heavy oil input) in upgraded products as added hydrogen expands the heavy oil total volume. The upgraded products, i.e., lower boiling hydrocarbons, in one embodiment include liquefied petroleum gas (LPG), gasoline, jet, diesel, vacuum gas oil (VGO), and fuel oils. In a second embodiment, the upgrade system provides a volume yield of at least 115% in the form of LPG, naphtha, jet diesel, VGO and fuel oils.

In one embodiment of the upgrade system, at least 98 wt % of heavy oil feed is converted to lighter products. In a second embodiment, at least 98.5% of heavy oil feed is converted to lighter products. In a third embodiment, the conversion rate is at least 99%. In a fourth embodiment, the conversion rate is at least 95%. In a fifth embodiment, the conversion rate is at least 80%. As used herein, conversion rate refers to the conversion of heavy oil feedstock to less than 1000° F. (538° C.) boiling point materials.

The hydrogen source, in some embodiments, is combined with carrier gas(es) and recirculated through the contacting zone. Carrier gas may be, for example, nitrogen, helium, and/or argon. The carrier gas may facilitate flow of the crude feed and/or flow of the hydrogen source in the contacting zone(s). The carrier gas may also enhance mixing in the contacting zone(s). In some embodiments, a hydrogen source (for example, hydrogen, methane or ethane) may be used as a carrier gas and recirculated through the contacting zone.

In one embodiment, the hydrogen feed enters the contacting zone co-currently with the heavy oil feed in the same conduit. In another embodiment, the hydrogen source may be added to the contacting zone in a direction that is counter to the flow of the crude feed. In a third embodiment, the hydrogen enters the contacting zone via a gas conduit separately from the combined heavy oil and slurry catalyst feed stream. In a fourth embodiment, the hydrogen feed is introduced directly to the combined catalyst and heavy oil feedstock prior to being introduced into the contacting zone. In yet another embodiment, the hydrogen gas and the combined heavy oil and catalyst feed are introduced at the bottom of the reactor as separate streams. In yet another embodiment, hydrogen gas can be fed to several sections of the contacting zone. In another embodiment, some of the hydrogen gas is fed to a preconditioning unit to precondition the slurry catalyst.

Process Conditions: In one embodiment of an upgrade process having a plurality of contacting zones, the process condition is controlled to be more or less uniformly across the contacting zones. In another embodiment, the condition varies between the contacting zones for upgrade products with specific properties.

In one embodiment, the process conditions are maintained under hydrocracking conditions, i.e., at a minimum temperature to effect hydrocracking of a heavy oil feedstock, e.g., a temperature of 410° C. to 482° C., and a pressure from 10 MPa to 25 MPa.

In one embodiment, the contacting zone process temperature ranges from about 410° C. (770° F.) to about 600° C. (1112° F.) in one embodiment, less than about 462° C. (900° F.) in another embodiment, more than about 425° C. (797° F.) in another embodiment. In one embodiment, the temperature difference between the inlet and outlet of a contacting zone ranges from 5 to 50° F. In a second embodiment, from 10 to 40° F.

In one embodiment, the temperature of the separation zone is maintained within ±90° F. (about ±50° C.) of the contacting zone temperature in one embodiment, within ±70° F. (about ±38.9° C.) in a second embodiment, and within ±15° F. (about ±8.3° C.) in a third embodiment, and within ±5° F. (about ±2.8° C.). In one embodiment, the temperature difference between the last separation zone and the immediately preceding contacting zone is within ±50° F. (about ±28° C.).

In one embodiment, the pressure of the separation zone is maintained within ±10 to ±50 psi of the preceding contacting zone in one embodiment, and within ±2 to ±10 psi in a second embodiment.

In one embodiment, the process pressure may range from about 10 MPa (1,450 psi) to about 25 MPa (3,625 psi), about 15 MPa (2,175 psi) to about 20 MPa (2,900 psi), less than 22 MPa (3,190 psi), or more than 14 MPa (2,030 psi).

In one embodiment, the liquid hourly space velocity (LHSV) of the heavy oil feed will generally range from about 0.025 $h^{-1}$ to about 10 $h^{-1}$, about 0.5 $h^{-1}$ to about 7.5 $h^{-1}$, about 0.1 $h.^{-1}$ to about 5 $h^{-1}$, about 0.75 $h^{-1}$ to about 1.5 $h^{-1}$, or about 0.2 $h^{-1}$ to about 10 $h^{-1}$. In some embodiments, LHSV is at least 0.5 $h^{-1}$, at least 1 $h^{-1}$, at least 1.5 $h^{-1}$, or at least 2 $h^{-1}$. In some embodiments, the LHSV ranges from 0.025 to 0.9 $h^{-1}$. In another embodiment, the LHSV ranges from 0.1 to 3 LHSV. In another embodiment, the LHSV is less than 0.5 $h^{-1}$.

In various embodiments, it is found that by diverting some, if not all, of the fresh catalyst to contacting zone(s) other than the first one in the system, the overall cracking efficiency of the heavy oil feedstock was not noticeably or at all impacted, as compared to the prior art feed scheme with all of the fresh catalyst going to the $1^{st}$ contact zone. In one embodiment, the shift in the location of the fresh catalyst injection yields a significant boost in overall catalytic activity, with the improved quality of the non-volatile stream from the last separation zone in the system (bleed stream, "Stripper Bottoms" or STB) in terms of API, viscosity, MCR level, nickel, Hydrogen/Carbon ratio, and hot heptane asphaltenes (HHA) level. In some other embodiments, less catalyst bleeding is also observed with the overall improvement in catalytic activity.

In one embodiment, the STB product improvements include a nickel reduction of at least 10%, in a second embodiment, a nickel reduction of at least 20%. In a third embodiment, a Ni level of less than 10 ppm.

In one embodiment, the MCR reduction in the STB is at least 5%. In another embodiment, the MCR reduction is at least 10%. In a third embodiment, the MCR level is less than 13 wt. %.

In one embodiment, the STB displays an API viscosity improvement of at least 15%. In a second embodiment, an API viscosity improvement of at least 30%. In a third embodiment, an API viscosity of at least 50%, going from 2.7 to 4.5. It is observed that in some embodiments, the improvement of the API is due to overall improved catalytic activity, thus resulting in a higher H/C ratio.

In embodiments with a heavy oil split feed scheme, it is found that by diverting a portion of the heavy oil feedstock from the first contacting zone to at least one other contact zone in the series, the overall coke formation is substantially reduced as compared to the feed scheme of the prior art with all of the heavy oil feedstock going to the $1^{st}$ contacting zone. Additionally, with at least a portion of the heavy oil feedstock being diverted to contacting zones other than the $1^{st}$ in the system, there is some liquid dilution in these contacting zones (that would not have been present in the prior art scheme). The liquid dilution allows a more uniform catalyst concentration profile across all reactors in the system, thus protecting the last reactor against solids level excursion that could lead to operation problems.

In some embodiments with a heavy oil split feed scheme, it is also observed that the overall system efficiency improves as the conversion level in the reactors (contacting zones) increases, allowing for additional oil vaporization and corresponding decrease in liquid throughput and increase in catalyst concentration. This would essentially boost the efficiency of the system with a lower liquid throughput (or higher liquid residence time) and higher catalyst concentration. Additionally, with a secondary steady heavy oil feed rate directly into the last reactor, the last reactor is protected against upset conditions that could deprive this vessel of liquid flow. Hence, the heavy oil split feed scheme reduces or eliminates "over-conversion events" or "dry" conditions often observed in hydroprocessing reactors. In upgrade system running under "dry" conditions, insufficient liquid flow is present thus leading to solids buildup/coking, degrading flow patterns and/or hydrodynamics, degrading thermometry, loss of reaction volume, eventually compromised performance, stability and longevity of the operation.

Reference will be made to the figures to further illustrate embodiments of the invention. FIG. 1 is a block diagram schematically illustrating a system for upgrading heavy oil feedstock. First, a heavy oil feedstock is introduced into the first contacting zone in the system together with a slurry catalyst feed. Hydrogen may be introduced together with the feed in the same conduit, or optionally, as a separate feed stream. In one embodiment (not shown), optional hydrocarbon oil feedstock such as VGO (vacuum gas oil), naphtha, MCO (medium cycle oil), solvent donor, or other aromatic solvents, etc. in an amount ranging from 2 to 30 wt. % of the heavy oil feed. The additional hydrocarbon feedstock may be used to modify the concentration of metals and impurities in the system. In the contacting zones under hydrocracking conditions, at least a portion of the heavy oil feedstock (higher boiling point hydrocarbons) is converted to lower boiling hydrocarbons, forming an upgraded product.

As illustrated, upgraded material is withdrawn from the $1^{st}$ contacting zone and sent to a separation zone, e.g., a hot separator. The upgraded material may be alternatively introduced into one or more additional hydroprocessing reactors (not shown) for further upgrading prior to going to the hot separator. The separation zone causes or allows the separation of gas and volatile liquids from the non-volatile fractions. The gaseous and volatile liquid fractions are withdrawn from the top of the separation zone for further processing. The non-volatile (or less volatile) fraction is withdrawn from the bottom. Slurry catalyst, small amounts of heavier hydrocracked liquid products, and entrained solids, coke, hydrocarbons newly generated in the hot separator, etc., are withdrawn from the bottom of the separator and fed to the next contacting zone in the series. In one embodiment (not shown), a portion of the non-volatile stream is recycled back to the contacting zone directly preceding the separation zone, in an amount equivalent to 2 to 40 wt. % of the total heavy oil feed.

The non-volatile stream from the preceding separation zone containing unconverted feedstock is combined with additional fresh catalyst, optional additional heavy oil feed, and optionally recycled catalyst (not shown) as the feed stream for the next contacting zone in the series.

In the next contacting zone and under hydrocracking conditions, more of the heavy oil feedstock is upgraded to lower boiling hydrocarbons. Upgraded materials along with slurry catalyst flow to the next separation zone in series for separation of gas and volatile liquids from the non-volatile fractions. The non-volatile (or less volatile) stream is withdrawn from the bottom. The gaseous and volatile liquid fractions are withdrawn from the top of the separation zone (and combined with the gaseous and volatile liquid fractions from a preceding separation zone) as "upgraded" products for further processing or blending, e.g., for final blended products meeting specifications designated by refineries and/or transportation carriers.

In one embodiment (not shown), the non-volatile material containing unconverted materials is sent to the next contacting zone in series. In another embodiment as shown, the non-volatile material is recycled back to one of the contacting zones in the system, with a portion of the material being bled off for further processing, e.g., going to a solvent deasphalting unit, a catalyst deoiling unit and subsequently a metal recovery system. The recycled non-volatile material in one embodiment is an amount equivalent to 2 to 50 wt. % of the heavy oil feedstock to the system, providing recycled catalyst for use in the hydroconversion reactions.

Depending on the operating conditions, the type of catalyst fed into the contacting zone and the concentration of the slurry catalyst, in one embodiment, the outlet stream from the contacting zones comprises a ratio of 20:80 to 60:40 of upgraded products to unconverted heavy oil feed. In one embodiment, the amount of upgraded products out of the first contacting zone is in the range of 30-35% to unconverted heavy oil product of 65-70%.

Although not shown in the figures, the system may optionally comprise recirculating/recycling channels and pumps for promoting the dispersion of reactants, catalyst, and heavy oil feedstock in the contacting zones. In one embodiment, a recirculating pump circulates through the loop reactor a volumetric recirculation ratio of 5:1 to 15:1 (recirculated amount to heavy oil feed ratio), thus maintaining a temperature difference between the reactor feed point to the exit point ranging from 10 to 50° F., and preferably between 20-40° F.

In one embodiment, the system may optionally comprise an in-line hydrotreater (not shown) for treating the gaseous and volatile liquid fractions from the separation zones. The in-line hydrotreater in one embodiment employs conventional hydrotreating catalysts, is operated at a similarly high pressure (within 10 psig in one embodiment, and 50 psig in a second embodiment) as the rest of the upgrade system, and capable of removing sulfur, Ni, V, and other impurities from the upgraded products.

Figure 2:
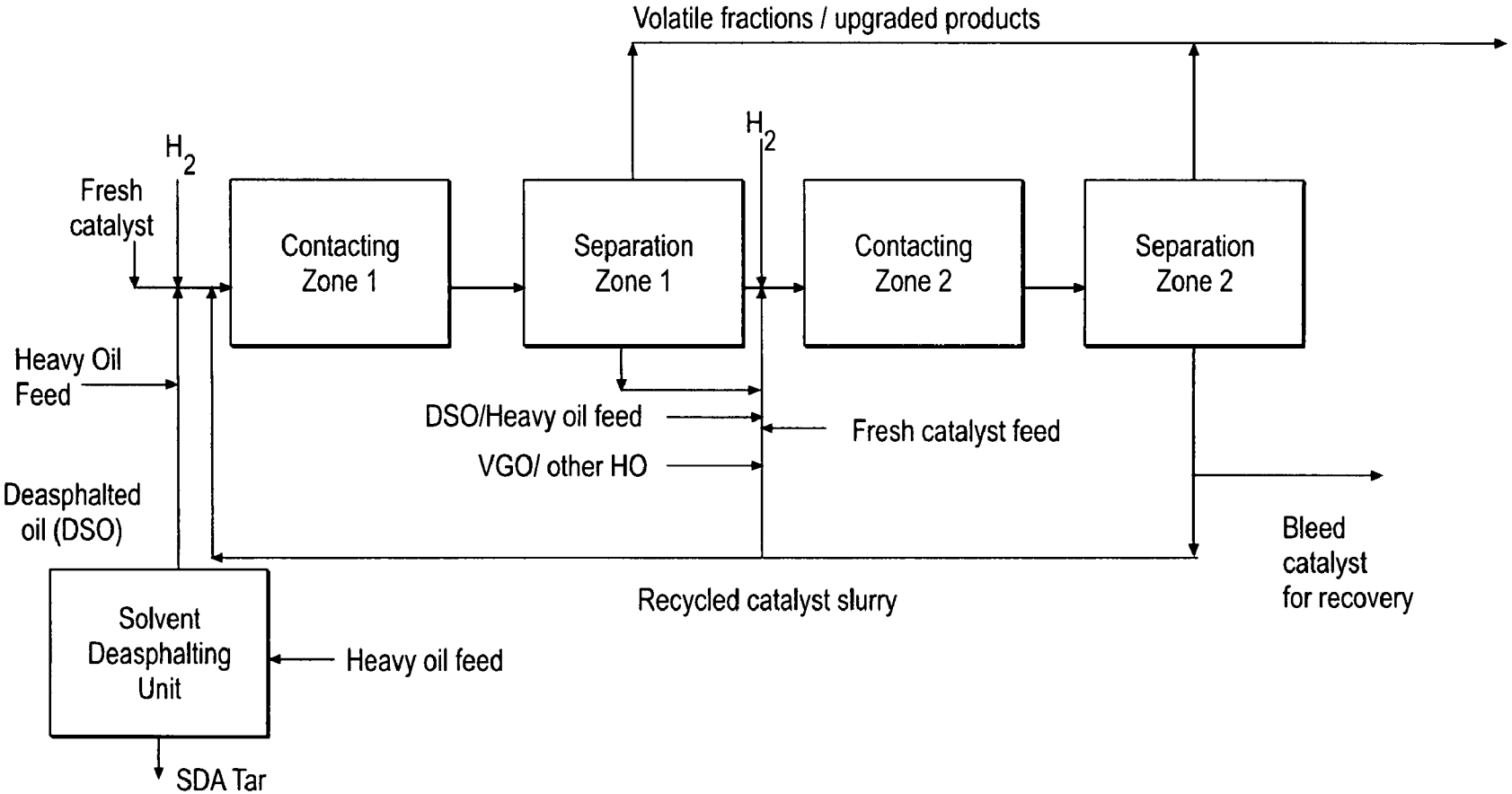
FIG. 2 is a block diagram that schematically illustrates another embodiment of a hydroprocessing system for upgrading a heavy oil feedstock with a solvent deasphalting unit for pre-treating the heavy oil feedstock.

FIG. 2 is a block diagram schematically illustrating another embodiment of an upgrade system, wherein a solvent deasphalting unit is employed for pre-treating some, if not all of the heavy oil feed to the system. The de-asphaltened oil (DAO) can be fed directly to the contacting zone(s) or combined with a heavy oil feed stream as a feedstock. In some embodiment, other hydrocarbon materials, e.g., VGO, can also be combined with the heavy oil feed and/or the DAO as the feedstock for some of the contacting zone(s). All of the fresh catalyst can be fed directly to the $1^{st}$ contacting zone in the system, or diverted to other contacting zone(s) in the series.

Figure 3:
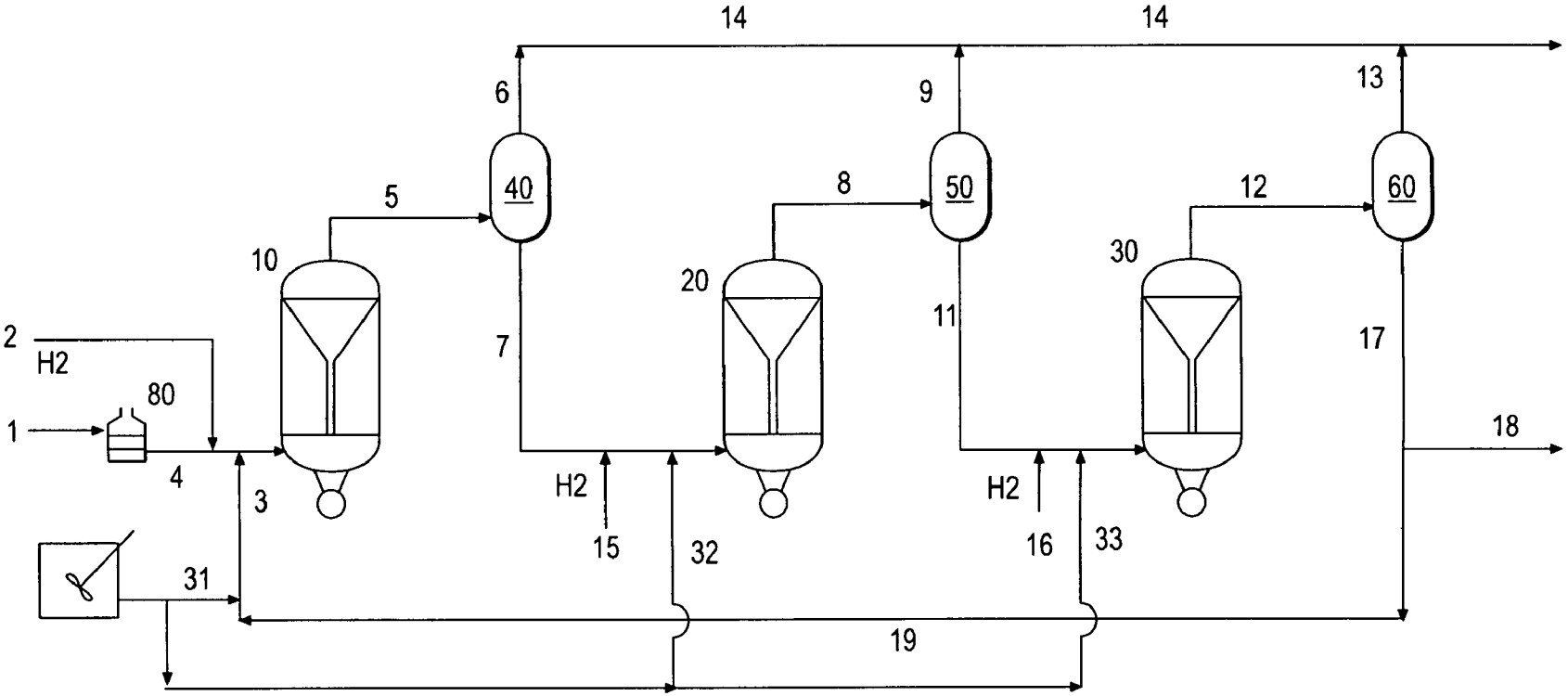
FIG. 3 is a flow diagram of a process to upgrade heavy oil feeds with an embodiment of the catalyst split feed scheme, wherein fresh catalyst feed is fed into all reactors in the process.

FIG. 3 is a flow diagram of a heavy oil upgrade process with a fresh catalyst split feed scheme, wherein some of the fresh catalyst feed is diverted from the first reactor to other reactors in the process. As shown, the fresh catalyst feed is split amongst the various contacting zones as feed streams 31, 32, and 33. Fresh catalyst feed 31 is combined with the recycle catalyst stream 17 and fed to the first contacting zone as slurry catalyst feed 3. Hydrogen gas 2 and heavy oil feedstock 1 are combined with slurry catalyst 3 as feed into the first contacting zone 10. In this embodiment, heavy oil feedstock is preheated in furnace 80 before being introduced into the contacting zone as heated oil feed 4.

Stream 5 comprising upgraded heavy oil feedstock exits the contacting zone 10 and flows to a separation zone 40, wherein gases (including hydrogen) and volatile upgraded products are separated from the non-volatile fractions 7 and removed overhead as stream 6. The non-volatile fractions stream 7 is sent to the next contacting zone 20 in series for further upgrade. Stream 7 contains slurry catalyst in combination with unconverted oil, and small amounts of coke and asphaltenes in some embodiments.

The upgrade process continues with the other contacting zones as shown, wherein stream 7 is combined with hydrogen feed 15 and fresh catalyst 32 as feed stream into contacting zone 20. Although not shown, the streams can also be fed to the contacting zone in separate conduits. Stream 8 comprising upgraded heavy oil feedstock flows to separation zone 50, wherein upgrade products are combined with hydrogen and removed as overhead product 9. Bottom stream 11 containing catalyst slurry, unconverted oil (plus small amounts of coke and asphaltenes in some embodiments) is combined with a fresh catalyst stream 33 and a fresh supply of hydrogen 16 as feed stream to the next contacting zone 30. Stream 12 exits the contacting zone and flows to separation zone 60, wherein upgraded products and hydrogen are removed overhead as stream 13. Some of the bottom stream 17 from the separation zone, which contains catalyst slurry, unconverted oil plus small amounts of coke and asphaltenes in some embodiments, is recycled back to the $1^{st}$ contacting zone 10 as recycled stream 19. The rest of the bottom stream 17 is removed as bleed-off stream 18 and sent to other processes in the system for catalyst de-oiling, metal recovery, etc. Although not shown, vapor stream 14 containing the upgraded products and hydrogen in one embodiment is subsequently processed in another part of the system, e.g., in a high pressure separator and/or lean oil contactor.

Figure 4:
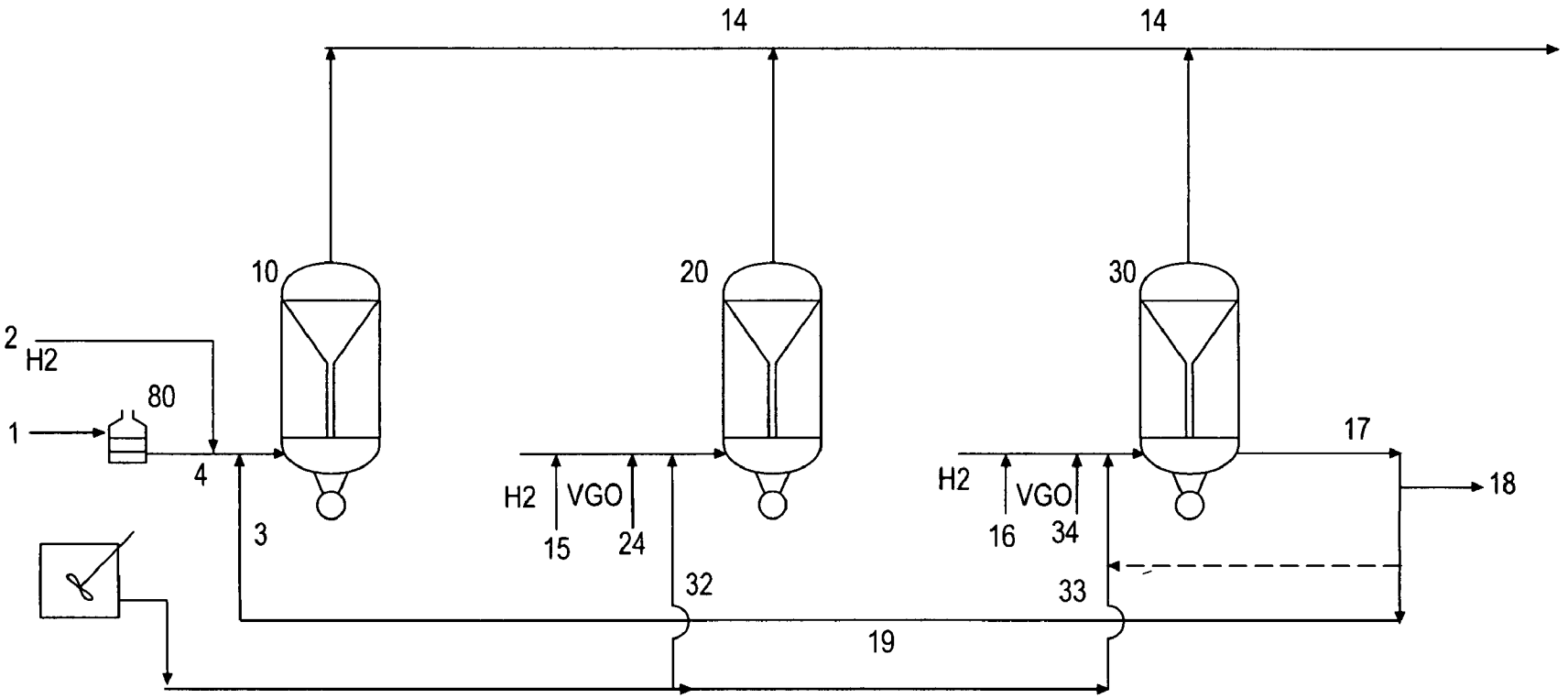
FIG. 4 is a flow diagram of a process to upgrade heavy oil feeds wherein the fresh catalyst feed is diverted from the first reactor to other reactors in the process, and wherein optional/additional hydrocarbon oil is fed to the reactors as feedstock.

FIG. 4 illustrates another embodiment of the invention, wherein reactors having internal separators are employed, thus separate hot separators/flash drums are not necessary for phase separation. In this upgrade system, a reactor differential pressure control system (not shown) is employed, regulating the product stream out of the top of each reactor-separator. External pumps (not shown) may be employed to aid in the dispersion of the slurry catalyst in the system and help control the temperature in the system.

In the embodiment of FIG. 4 as shown, all of fresh catalyst is diverted to the $2^{nd}$ and $3^{rd}$ contacting zones in the system. Recycled catalyst stream 19 provides slurry catalyst feed to the first contacting zone, and optionally, to other contacting zone(s) in the system. Also as shown, additional hydrocarbon oil feed, e.g., VGO, naphtha, in an amount ranging from 2 to 30 wt. % of the heavy oil feed can be optionally added as part of the feed stream to any of the contacting zones in the system.

Figure 5:
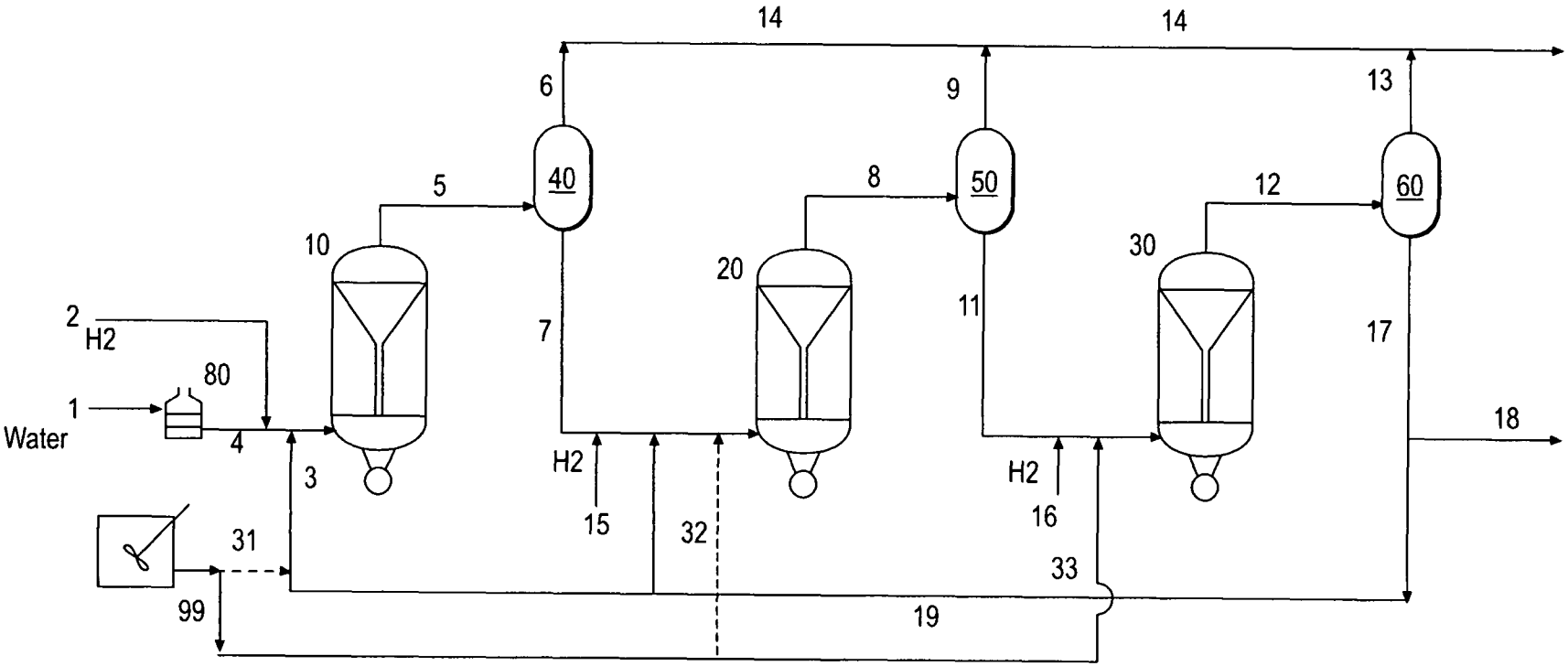
FIG. 5 is a flow diagram of another embodiment of a process to upgrade heavy oil feeds, wherein all of the fresh catalyst feed is sent to the last reactor in the process.

FIG. 5 illustrates an embodiment of the invention wherein all of the fresh catalyst feed 99 is fed directly to the last contacting zone in the upgrade system, with other contacting zone(s) in the system simply getting a portion of the recycled catalyst stream 19.

Figure 6:
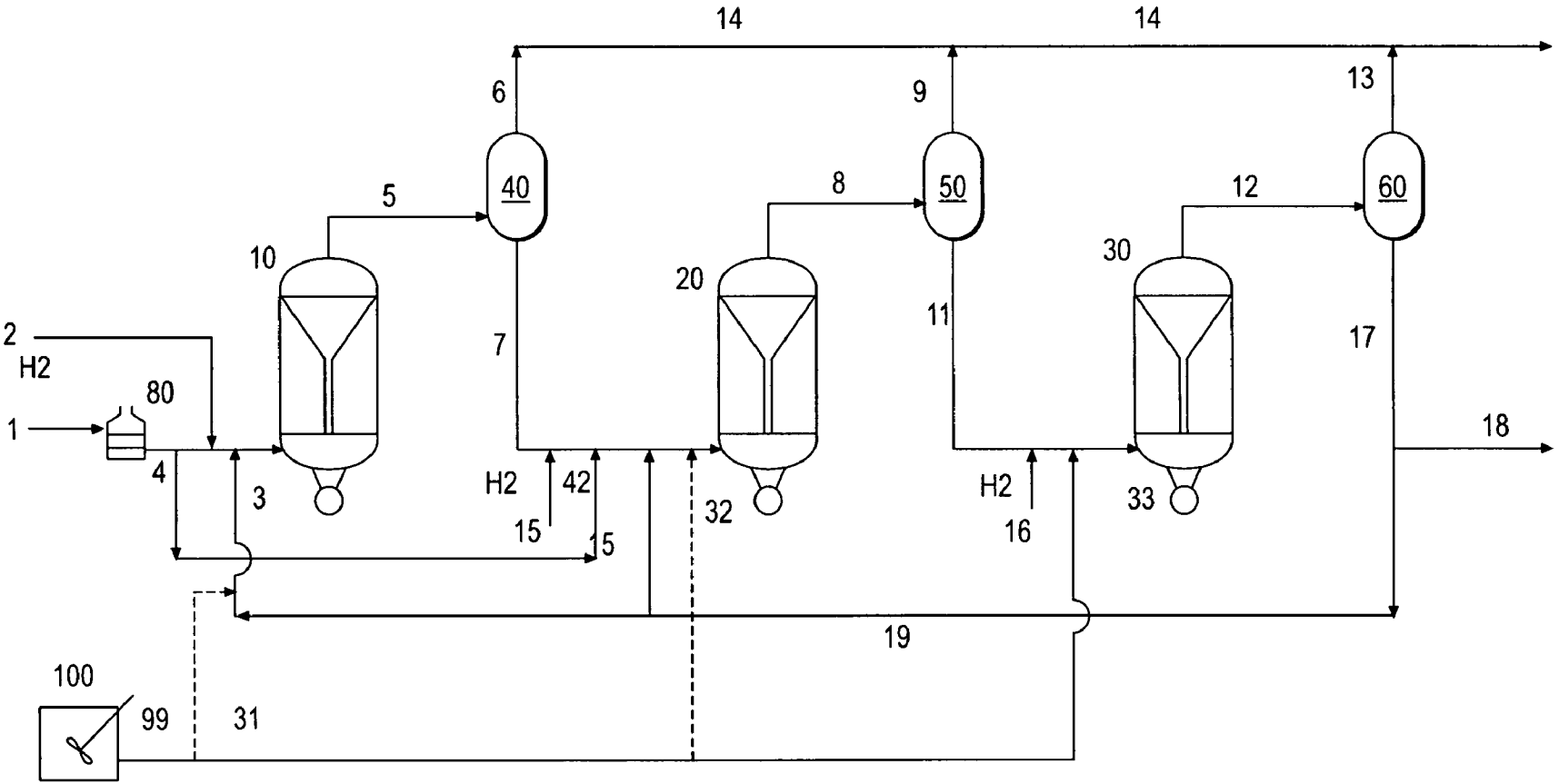
FIG. 6 is a flow diagram of another embodiment of a process to upgrade heavy oil feeds, wherein some of the untreated heavy oil feed is diverted from the first reactor sent to other reactors in the process.

FIG. 6 illustrates is an embodiment of a heavy oil split feed scheme. As shown, some of heavy oil feed is diverted from the $1^{st}$ reactor and fed directly to the $2^{nd}$ contacting zone in the system as heavy oil feed stream 42. Also as shown, recycled catalyst is optionally sent to the $2^{nd}$ contacting zone in the system along with portions of the fresh catalyst as stream 32.

The following examples are given as non-limitative illustration of aspects of the present invention.

COMPARATIVE EXAMPLE 1

Heavy oil upgrade experiments were carried out in a pilot system having three gas-liquid slurry phase reactors connected in series with two hot separators. The hot separators are connected in series with the $1^{st}$ and $3^{rd}$ reactors respectively, with no hot separator following the $2^{nd}$ reactor. The gas-liquid slurry phase reactors were continuously stirred reactors. The upgrade system was run continuously for about 70 days.

A fresh slurry catalyst used was prepared according to the teaching of US Patent No. 2006/0058174. i.e., a Mo compound was first mixed with aqueous ammonia forming an aqueous Mo compound mixture, sulfided with hydrogen/sulfur compound, promoted with a Ni compound, then transformed in a hydrocarbon oil (other than heavy oil feedstock) at a temperature of at least 350° F. and a pressure of at least 200 psig, forming an active slurry catalyst.

In Comparative Example 1, all of the fresh catalyst slurry was sent to the first reactor in the system, for a concentration of fresh slurry catalyst in heavy oil ranging from 2,000 to 5,000 ppm, expressed as weight of metal (molybdenum) to weight of heavy oil feed. The hydroprocessing conditions were as follows: a reactor temperature of 815-825° F.; a total pressure in the range of 2400 to 2600 psig; a fresh Mo/fresh heavy oil feed ratio (wt. %) 0.20-0.40; fresh Mo catalyst/total Mo catalyst ratio 0.1; total feed LHSV 0.10 to 0.15; and $H_2$ gas rate (SCF/bbl) of 10000 to 15000.

Effluent taken from the $1^{st}$ and $3^{rd}$ reactors was introduced into the hot separators connected in series with the reactors, and separated into a hot vapor stream and a non-volatile stream. Vapor streams were removed from the top of the high pressure separators and collected for further analysis ("HPO" or high-pressure overhead streams). The non-volatile stream containing slurry catalyst and unconverted heavy oil feedstock was removed from the bottom of the $1^{st}$ separator and sent to the $2^{nd}$ reactor in series. Effluent from the $2^{nd}$ reactor was sent directly to the $3^{rd}$ reactor as feedstock.

A portion of the non-volatile stream from the last separator in an amount of 5-15 wt. % of heavy oil feedstock was removed as the bleed-off stream, for an overall conversion rate of 98 to 98.5% of heavy oil feed to distillate products. The rest of the non-volatile stream, the "Stripper Bottoms product" or STB, containing the bulk of the catalyst (in an amount of 80 to 95% of total slurry catalyst entering the system) was recycled back to the first reactor for maintaining the flow of catalyst through the upgrade system. The STB stream contains about 7 to 20 wt% slurry catalyst. The STB was also analyzed to evaluate the overall performance of the system.

The feed blend to the system was a heavy oil feed with the properties specified in Table 1.

TABLE 1

| | VR Properties |
|---|---|
| API gravity at 60/60 | 4.6 |
| Specific gravity | 1.04 |
| Sulfur (wt %) | 1.48 |
| Nitrogen (ppm) | 11069 |
| Nickel (ppm) | 118.8 |
| Vanadium (ppm) | 108.7 |
| Carbon (wt %) | 83.57 |
| Hydrogen (wt %) | 10.04 |
| MCR (wt %) | 20.7 |
| Viscosity @ 100° C. (cSt) | 20796 |
| Pentane Asphaltenes (wt %) | 13.9 |
| Fraction Boiling above 1000° F. (wt %) | 100% |

EXAMPLE 2

After 70 days with all of the fresh catalyst to the $1^{st}$ reactor, the location of fresh catalyst supply was shifted from the $1^{st}$ to the $3^{rd}$ reactor, with the first two reactors relying entirely on recycled catalyst feed stream for 28 days. All other process conditions remained the same. HPO and STB products were collected, analyzed, and compared with the results of Comparative Example 1. There was no significant change in HPO product quality With respect to the STB product, the results are as follows:

TABLE 2

| STB Product properties | Comparative Example 1 | Example 2 |
|---|---|---|
| Wt % VR (BP 1000° F.) | 15.9 | 15.3 |
| Wt % HVGO (BP 800° F.) | 49.8 | 48.6 |
| Wt % VGO (BP 650° F.) | 79.8 | 80.0 |
| API | 2.7 | 4.5 |
| Sulfur (wt. %) | 0.12 | 0.16 |
| Nitrogen (ppm) | 12711 | 12335 |
| MCR (wt. %) | 14.7 | 12.4 |
| Hydrogen/Carbon ratio | 0.098 | 0.102 |
| Ni (ppm) | 10.8 | 7.9 |
| Hot heptane asphaltenes, ppm | 174255 | 119713 |
| Viscosity @70° C., cSt | 68.4 | 47.3 |

The results show that diverting the fresh catalyst to the last contacting zone in the system did not trigger changes in product nitrogen levels. However, there was a change in the sulfur level, which could be due to the unusually low sulfur level in the heavy oil feed to the system and the high sulfur level in the VGO oil used in the slurry catalyst feed. It is therefore possible that injecting the fresh catalyst into the last reactor penalized the product sulfur by providing less time for the VGO oil carrier (in the slurry catalyst) to react, resulting into a higher product sulfur level. It is further noted that by diverting the fresh catalyst to the last reactor yielded a STB product with improved properties, including API, viscosity, MCR, HHA, nickel, and H/C ratio. The improvement in STB product API did not correlate with an improvement in the distillation of the STB product. In other words, the STB product API did not improve due to additional cracking in a lighter product distillation, but due to improved catalytic activity, resulting into a higher H/C ratio.

With respect to the system operation in the 28-day run, there was no evidence of pressure-drop buildup or plugging around the front end reactors to suggest any coking or solid build-ups. There was no measurable negative impact on the overall conversion rate. The results suggest the used catalyst has retained sufficient hydrogenation activity to starve off coking, even in the presence of fresh/untreated heavy oil feedstock, indicating that a fresh catalyst split scheme still suppresses coking adequately.

EXAMPLE 3

Example 1 is repeated except that 20% of the heavy oil feedstock is diverted from the $1^{st}$ reactor to the $3^{rd}$ reactor while other process conditions remain the same.

In comparing process stability, reactor performance, and reactor conditions between the examples, it is believed that in Example 1. the $3^{rd}$ reactor has a lower liquid throughput (with no heavy oil feed) and higher catalyst concentration which are directionally beneficial for conversion purposes. However, these conditions also tend to make the last reactor more susceptible to operation upsets leading to insufficient liquid flow-through, and consequentially, more solids build-up, degrading thermometry and shortening of the process runtime.

In Example 3 with a portion of the heavy oil feedstock being fed directly to the last reactor, it is anticipated that the preceding reactors ($1^{st}$ and $2^{nd}$) with a decrease in liquid throughput (as a portion of the heavy oil feedstock is diverted) and a corresponding increase in catalyst concentration will operate more efficiently and with a higher conversion rate. Additionally, with more liquid dilution in the $3^{rd}$ reactor, there is a more uniform catalyst concentration profile across all three reactors.

It is further anticipated that as the last reactor in the series gets a portion of the heavy oil feed, dry conditions associated with insufficient liquid flow is obviated. As the last reactor is protected from over-conversion events or dry conditions, there is less solid build-up or coke deposition. It is also expected that the last reactor is less susceptible to operation upsets, e.g., wide swings in temperature, pressure, flows, etc.

For the purpose of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that may vary depending upon the desired properties sought to be obtained and/or the precision of an instrument for measuring the value, thus including the standard deviation of error for the device or method being employed to determine the value. The use of the term "or" in the claims is used to mean "and/or" unless explicitly indicated to refer to alternatives only or the alternative are mutually exclusive, although the disclosure supports a definition that refers to only alternatives and "and/or." The use of the word "a" or "an" when used in conjunction with the term "comprising" in the claims and/or the specification may mean "one," but it is also consistent with the meaning of "one or more," "at least one," and "one or more than one." Furthermore, all ranges disclosed herein are inclusive of the endpoints and are independently combinable. In general, unless otherwise indicated, singular elements may be in the plural and vice versa with no loss of generality. As used herein, the term "include" and its grammatical variants are intended to be non-limiting, such that recitation of items in a list is not to the exclusion of other like items that can be substituted or added to the listed items.

It is contemplated that any aspect of the invention discussed in the context of one embodiment of the invention may be implemented or applied with respect to any other embodiment of the invention. Likewise, any composition of the invention may be the result or may be used in any method or process of the invention. This written description uses examples to disclose the invention, including the best mode, and also to enable any person skilled in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. All citations referred herein are expressly incorporated herein by reference.

The invention claimed is:

1. A process for hydroprocessing a heavy oil feedstock, the process employing a plurality of contacting zones and separation zones, including a first contacting zone and a contacting zone other than the first contacting zone, the process comprising:

providing a hydrogen containing gas feed and a slurry catalyst feed;

providing a heavy oil feedstock, wherein at least a portion of the heavy oil feedstock is for feeding a contacting zone other than the first contacting zone;

combining a portion of the hydrogen containing gas feed, a portion of the heavy oil feedstock, and the slurry catalyst in a first contacting zone under hydrocracking conditions to convert at least a portion of the heavy oil feedstock to lower boiling hydrocarbons, forming upgraded products;

sending a mixture of the upgraded products, the slurry catalyst, the hydrogen containing gas, and unconverted heavy oil feedstock to a first separation zone, wherein volatile upgraded products are removed with the hydrogen containing gas from the first separation zone as a first overhead stream, and the slurry catalyst, heavier hydrocracked liquid products, and the unconverted heavy oil feedstock are removed from the first separation zone as a first non-volatile stream, and;

sending at least a portion of the heavy oil feedstock and the first non-volatile stream to a contacting zone other than the first contacting zone, which contacting zone is maintained under hydrocracking conditions with additional hydrogen containing gas feed to convert at least a portion of the heavy oil feedstock to lower boiling hydrocarbons, forming additional upgraded products;

sending a mixture comprising the additional upgraded products, the slurry catalyst, the additional hydrogen containing gas, and unconverted heavy oil feedstock to a separation zone other than the first separation zone, whereby additional volatile upgraded products are removed with the additional hydrogen containing gas as an overhead stream and the slurry catalyst and the unconverted heavy oil feedstock are removed as a second non-volatile stream.

2. The process of claim 1, wherein at least 5% of the heavy oil feedstock is for feeding a contacting zone other than the first contacting zone.

3. The process of claim 1, wherein at least 5% of the heavy oil feedstock is for feeding a last contacting zone.

4. The process of claim 1, wherein less than 80% of the heavy oil feedstock is for feeding the first contacting zone, and remainder of the heavy oil feedstock is for feeding at least a contacting zone other than the first contacting zone.

5. The process of claim 1, wherein the process employs three contacting zones, and at least 10% of the heavy oil feedstock is for feeding the third contacting zone.

6. The process of claim 1, wherein a sufficient amount of a hydrogen containing gas feed is provided for the process to have a volume yield of at least 115% in upgraded products comprising liquefied petroleum gas, gasoline, diesel, vacuum gas oil, and jet and fuel oils.

7. The process of claim 1, wherein at least a portion of the second non-volatile stream is recycled to the first contacting zone for use as a spent slurry catalyst, and remainder of the second non-volatile stream is removed from the process as a bleed-off stream in an amount sufficient for the process to have a conversion rate of at least 98%.

8. The process of claim 7, wherein the second non-volatile stream for recycling to the first contacting zone ranges between 2 to 50 wt. % of the heavy oil feedstock to the process.

9. The process of claim 7, wherein the bleed-off stream contains between 3 to 30 wt. % solid, as spent slurry catalyst.

10. The process of claim 7, wherein a sufficient amount of the second non-volatile stream is removed as a bleed-off stream for the process to have a conversion rate of at least 98.5%.

11. The process of claim 10, wherein the bleed-off stream contains between 5 to 20 wt. % solid, as spent slurry catalyst.

12. The process of claim 1, wherein the contacting zones are maintained hydrocracking conditions of a temperature of 410° C. to 600° C., and a pressure from 10 MPa to 25 MPa.

13. The process of claim 1, wherein the separation zones are maintained at a temperature within 90° F. of the temperature of the contacting zones, and a pressure within 10 psi of the pressure in the contacting zones.

14. The process of claim 1, wherein the slurry catalyst has an average particle size in the range of 1-20 microns.

15. The process of claim 14, wherein the slurry catalyst comprises clusters of colloidal sized particles of less than 100 nm in size, wherein the clusters have an average particle size in the range of 1-20 microns.

16. The process of claim 1, wherein the process employ a plurality of contacting zones and separation zones, at wherein at least one contacting zone and at least one separation zone are combined into one equipment as a reactor having an internal separator.

17. The process of claim 1, further comprising a plurality of recirculating pumps for promoting dispersion of the heavy oil feedstock and the slurry catalyst in the contacting zones.

18. The process of claim 1, wherein additional hydrocarbon oil feed other than heavy oil feedstock, in an amount ranging from 2 to 30 wt. % of the heavy oil feedstock, is added to any of the contacting zones.

19. The process of claim 18, wherein the additional hydrocarbon oil feed is selected from vacuum gas oil, naphtha, medium cycle oil, solvent donor, and aromatic solvents.

20. The process of claim 1, further comprising an in-line hydrotreater employing hydrotreating catalysts and operating at a pressure within 50 psig of the contacting zones, for removing at least 70% of sulfur, at least 90% of nitrogen, and at least 90% of heteroatoms in the upgraded products.

21. The process of claim 1, for treating a heavy oil feedstock having a TAN of at least 0.1; a viscosity of at least 10 cSt; an API gravity at most 15; at least 0.0001 grams of Ni/V/Fe; at least 0.005 grams of heteroatoms; at least 0.01 grams of residue; at least 0.04 grams C5 asphaltenes; and at least 0.002 grams of MCR.

22. The process of claim 1, wherein the slurry catalyst feed comprises a spent slurry catalyst and optionally, a fresh slurry catalyst.

23. The process of claim 22, wherein a fresh slurry catalyst is fed into a contacting zone other than the first contacting with the additional hydrogen containing gas feed.

24. The process of claim 23, wherein all of the fresh slurry catalyst is for feeding into contacting zones other than the first contacting zone.

25. The process of claim 1, further comprising recycling to the first contacting zone at least a portion of the second non-volatile stream.

26. A process for hydroprocessing a heavy oil feedstock, the process employing a plurality of contacting zones and a plurality of separation zones, the process comprising:

providing a hydrogen containing gas feed;

providing a fresh slurry catalyst feed for feeding at least a contacting zone other than the first contacting zone;

providing a heavy oil feedstock, wherein at least a portion of the heavy oil feedstock is for feeding a contacting zone other than the first contacting zone;

providing a slurry catalyst comprising a spent slurry catalyst for feeding the first contacting zone, combining a portion of the hydrogen containing gas feed, at least a portion of the heavy oil feedstock, and the slurry catalyst in a first contacting zone under hydrocracking conditions to convert at least a portion of the heavy oil feedstock to lower boiling hydrocarbons, forming upgraded products;

sending a mixture of the upgraded products, the slurry catalyst, the hydrogen containing gas, and unconverted heavy oil feedstock to a first separation zone, wherein volatile upgraded products are removed with the hydrogen containing gas from the first separation zone as a first overhead stream, and the slurry catalyst, heavier hydrocracked liquid products, and the unconverted heavy oil feedstock are removed from the first separation zone as a first non-volatile stream, and;

sending at least a portion of the heavy oil feedstock and the first non-volatile stream to a contacting zone other than the first contacting zone, which contacting zone is maintained under hydrocracking conditions with additional hydrogen containing gas feed and at least a portion of the fresh slurry catalyst feed to convert at least a portion of the unconverted heavy oil feedstock to lower boiling hydrocarbons, forming additional upgraded products;

sending a mixture of the additional upgraded products, the slurry catalyst, the additional hydrogen containing gas, and unconverted heavy oil feedstock to a separation zone other than the first separation zone, whereby volatile additional upgraded products are removed with the additional hydrogen containing gas as an overhead stream and the slurry catalyst and the unconverted heavy oil feedstock are removed as a second non-volatile stream;

recycling to the first contacting zone at least a portion of the second non-volatile stream.

* * * * *